US007739797B2

(12) United States Patent
Rawle

(10) Patent No.: US 7,739,797 B2
(45) Date of Patent: Jun. 22, 2010

(54) SHAVING RAZOR

(75) Inventor: Stephen Leonard Rawle, Newbury (GB)

(73) Assignee: The Gillette Company, Boston, MA (US)

( * ) Notice: Subject to any disclaimer, the term of this patent is extended or adjusted under 35 U.S.C. 154(b) by 0 days.

(21) Appl. No.: 12/430,267

(22) Filed: Apr. 27, 2009

(65) Prior Publication Data

US 2009/0205207 A1 Aug. 20, 2009

Related U.S. Application Data

(63) Continuation of application No. 11/486,641, filed on Jul. 14, 2006, now Pat. No. 7,540,087.

(51) Int. Cl.
*B26B 21/22* (2006.01)

(52) U.S. Cl. ..... 30/34.1; 30/34.05; 30/50

(58) Field of Classification Search ..... 30/34.05, 30/34.1, 50; D28/46
See application file for complete search history.

(56) References Cited

U.S. PATENT DOCUMENTS

| | | | | |
|---|---|---|---|---|
| 3,203,093 | A | 3/1963 | Kuhnl | |
| 3,263,328 | A | 8/1966 | Craig | |
| 3,335,490 | A | 8/1967 | Warner | |
| 3,555,681 | A | 1/1971 | Kuhnl | |
| 3,979,825 | A | 9/1976 | Baumann | |
| 4,835,861 | A | 6/1989 | Mahlich | |
| D345,232 | S | 3/1994 | Gray | |
| 5,782,148 | A | 7/1998 | Kerkhoven | |
| 6,298,558 | B1 | 10/2001 | Tseng et al. | |
| 6,557,262 | B1 | 5/2003 | Clemence et al. | |
| 6,601,302 | B2 | 8/2003 | Andrew | |
| 6,739,054 | B2 | 5/2004 | Oswald | |
| 7,540,087 | B2 * | 6/2009 | Rawle | 30/34.1 |
| 2002/0007870 | A1 | 1/2002 | Ohata et al. | |
| 2002/0178586 | A1 | 12/2002 | Oswald | |
| 2005/0022386 | A1 | 2/2005 | Macove | |
| 2005/0039337 | A1 | 2/2005 | Pennell et al. | |
| 2006/0196054 | A1 | 9/2006 | Luxton | |

FOREIGN PATENT DOCUMENTS

| | | | |
|---|---|---|---|
| DE | 3136033 | A1 | 3/1983 |

* cited by examiner

*Primary Examiner*—Hwei-Siu C Payer
(74) *Attorney, Agent, or Firm*—John M. Lipchitz; Kevin C. Johnson; Steven W. Miller

(57) ABSTRACT

A shaving razor having a housing. The housing includes a plurality of shaving blades and a separate trimming blade. The trimming blade has a trimming blade edge. A trimming blade alignment member is provided on the housing for aligning the trimming blade edge which is visually concealed by said housing on a user's skin for accurate shaving.

20 Claims, 5 Drawing Sheets

SHAVING RAZOR

CROSS REFERENCE TO RELATED APPLICATIONS

This application is a continuation of U.S. application Ser. No. 11/486,641 filed on Jul. 14, 2006, now U.S. Pat. No. 7,540,087.

FIELD OF THE INVENTION

The present invention relates to a shaving razor and more particularly to a shaving razor having an alignment member for aligning a blade edge on a user's skin for accurate shaving.

BACKGROUND OF THE INVENTION

In recent years shaving razors with numerous blades have been proposed in the literature and commercialized, e.g., in United States 2005/0039337 A1 published on Feb. 24, 2005, which generally describes a type of design that has been commercialized as the five bladed Fusion™ razor by The Gillette Company.

Increasing the number of blades on a shaving razor generally tends to increase the shaving efficiency of the razor and provide better distribution of compressive forces on the skin but can reduce the ability to trim, e.g., sideburns or near the nose. In order to improve the ability to trim an extra blade mounted on the rear of the razor cartridge has been provided to improve the ability to trim. Such a design with an extra blade is described in the aforementioned United States 2005/0039337 A1 and commercialized in the Fusion™ razor by The Gillette Company.

While a trimming blade is very useful for trimming hair of the sideburn or near the nose, it is difficult to locate the exact location of the trimming blade as the trimming blade is hidden from view by the razor cartridge. When hidden it is difficult for the user to accurately position the trimming blade on the skin for precise trimming. The inability to accurately position the trimming blade can result in a less than accurate shave producing a less than satisfactory shaving experience.

It is therefore desirable to provide the shaving razor with an alignment member on the housing enabling the user to properly align the trimming blade on the user's skin during shaving.

SUMMARY OF THE INVENTION

In one aspect, the invention features, in general, a shaving razor including a housing, the housing including a plurality of shaving blades and a separate trimming blade, the trimming blade having a trimming blade edge, the housing visually concealing the trimming blade edge, and a trimming blade alignment member on the housing for aligning the trimming blade edge which is visually concealed by the housing on a user's skin for accurate shaving.

In another aspect, the invention features, in general, a trimming blade alignment member that provides a visual indication of the trimming blade edge position. The trimming blade alignment member may be a linear marking on the housing, a recess in the housing, a protrusion from the housing, a high illumination element, a luminescent marking which in turn comprises an electrically activated component, and may be a first color which is different from the color of the housing.

In another aspect, the invention features, in general, a trimming blade alignment member that indicates an angle at which the housing is to be held relative to the user's skin during shaving.

In another aspect, the invention features, in general, a shaving razor including a housing, the housing includes a plurality of shaving blades, the shaving blades include a shaving blade edge facing in a first direction, a separate trimming blade is located in the housing, the trimming blade has a trimming blade edge, the housing visually conceals the trimming blade edge, the trimming blade edge faces in a second direction different from the first direction, and a trimming blade alignment member on the housing for aligning the trimming blade edge which is visually concealed by the housing on a user's skin for accurate shaving with said trimming blade.

In another aspect, the invention features, in general, a shaving razor wherein skin contact surfaces are provided on the housing for contact with the skin in front of and behind the trimming blade during the performance of a shaving stroke, and the linear marking extends substantially perpendicular to a plane tangential to the skin contact surfaces and substantially intersects a blade edge position projected longitudinally of the blade edge.

DETAILED DESCRIPTION OF THE INVENTION

Figure 1:
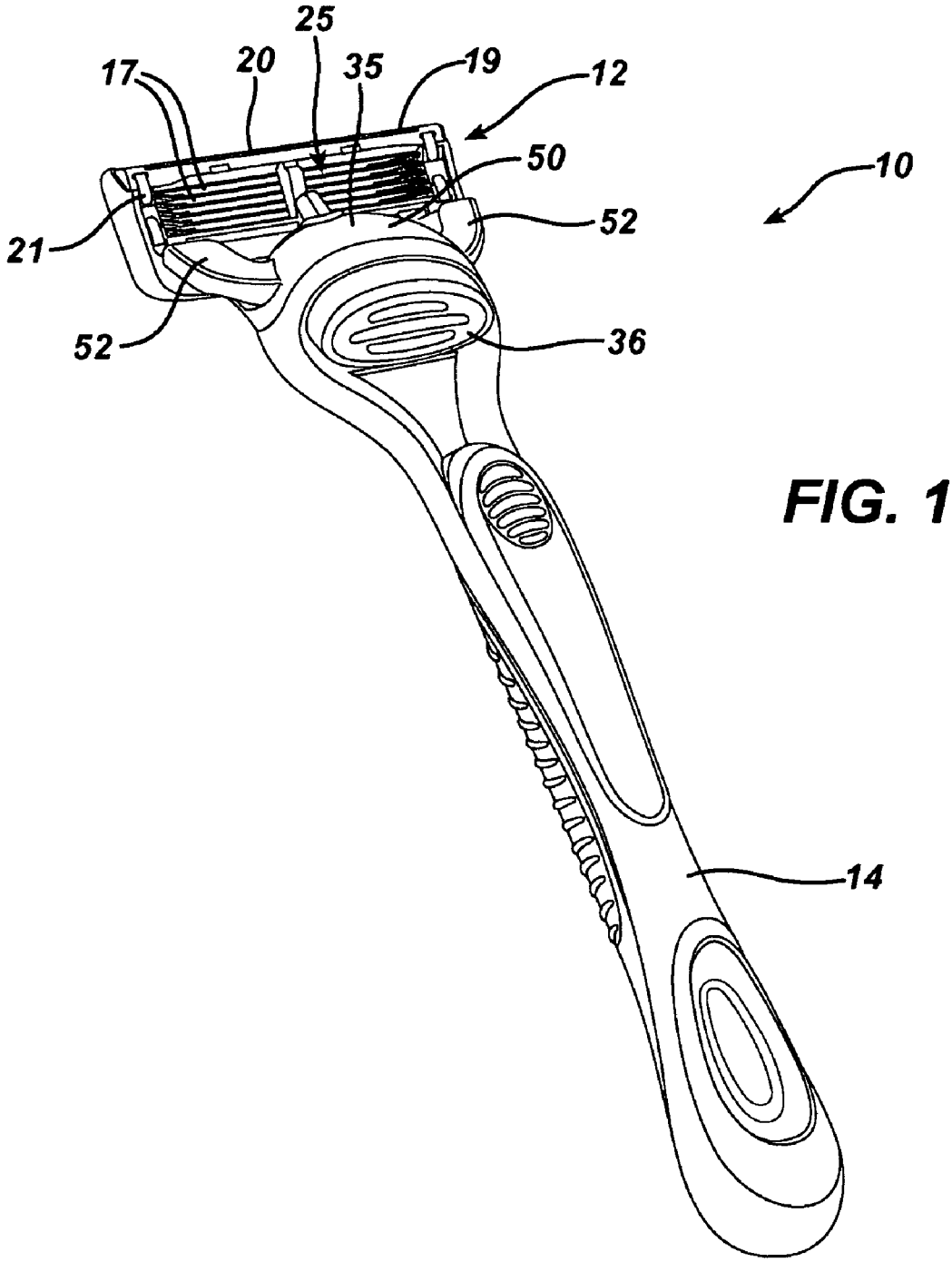
FIG. 1 is a perspective view of a shaving razor.
Figure 2:
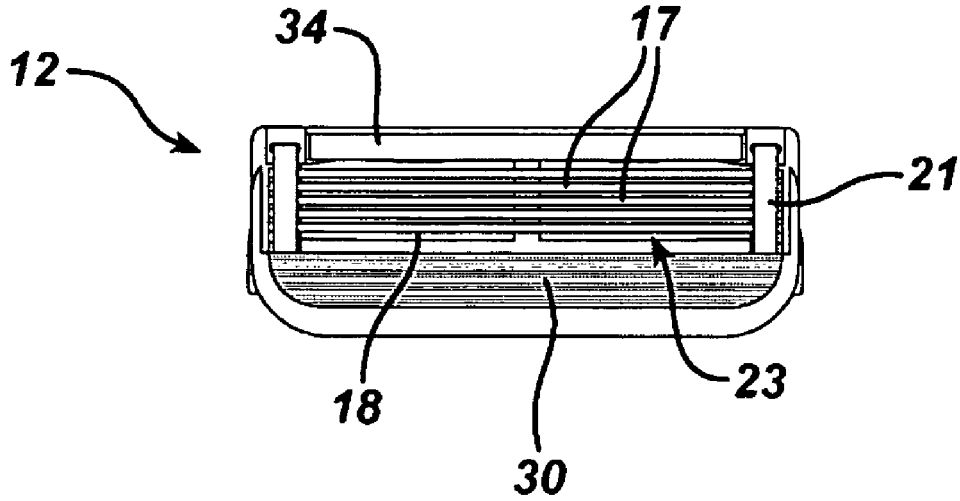
FIG. 2 is a plan view of the front or first side of the housing of the shaving razor shown in FIG. 1.
Figure 3:
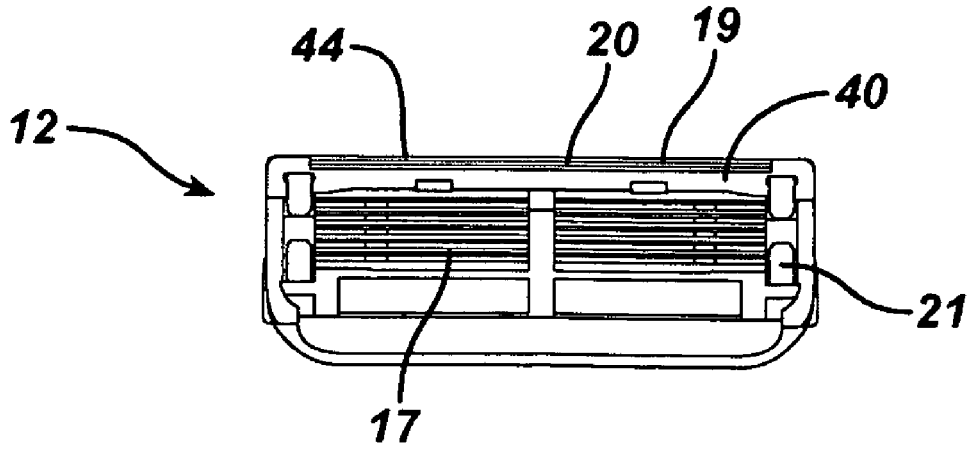
FIG. 3 is a plan view of the back or second side of the housing of the shaving razor shown in FIG. 1.

Referring to FIGS. 1-3, shaving razor 10 includes a housing or cartridge 12 detachably joined to handle 14. The housing 12 includes one or more first blades 17 mounted in housing 12 and a separate second or trimmer blade 19 mounted in housing 12. The blades 17 and 19 are held in the housing 12 by metal clips 21. The first blades 17 have substantially parallel sharp cutting edges 18 and extend in a first direction. The second or trimming blade 19 has a sharp cutting edge 20 that extends in a second direction different from the first direction. The first blades 17 have their cutting edges 18 on the first side 23 of housing 12 whereas the second blade 19 has its cutting edge 20 on the opposite second side 25 of housing 12.

Referring now to FIG. 2, a guard structure 30 is provided on housing 12 for contacting the skin in front of blades 17 and a cap structure 34 is provided on housing 12 for contacting the skin behind blades 17 during the shaving stroke. The guard structure 30 may comprise an elastomeric material. The cap structure 34 may comprise a lubricating strip.

Referring now to FIG. 3, a guard structure 40 is provided on the housing 12 for contacting the skin in front of blade 19 and a cap structure 44 is provided on housing 12 for contacting the skin behind blade 19 during the shaving stroke. The guard structure 40 may comprise an elastomeric material. The cap structure 44 may comprise a lubricating strip.

Referring now to FIG. 1, housing 12 is pivotally joined on a yoke member 50 having a pair of arms 52 which extended from a hub 35 and are journalled in opposite ends of housing 12 can pivot relative to handle 14 about an axis substantially parallel to the blade edges. Hub 35 selectively attaches to and detaches from handle 14. Any known hub can be utilized. In this embodiment release button 36 cooperates with hub 35 such that when release button 36 is pressed inward, hub 35 is disengaged from handle 14.

Figure 4:
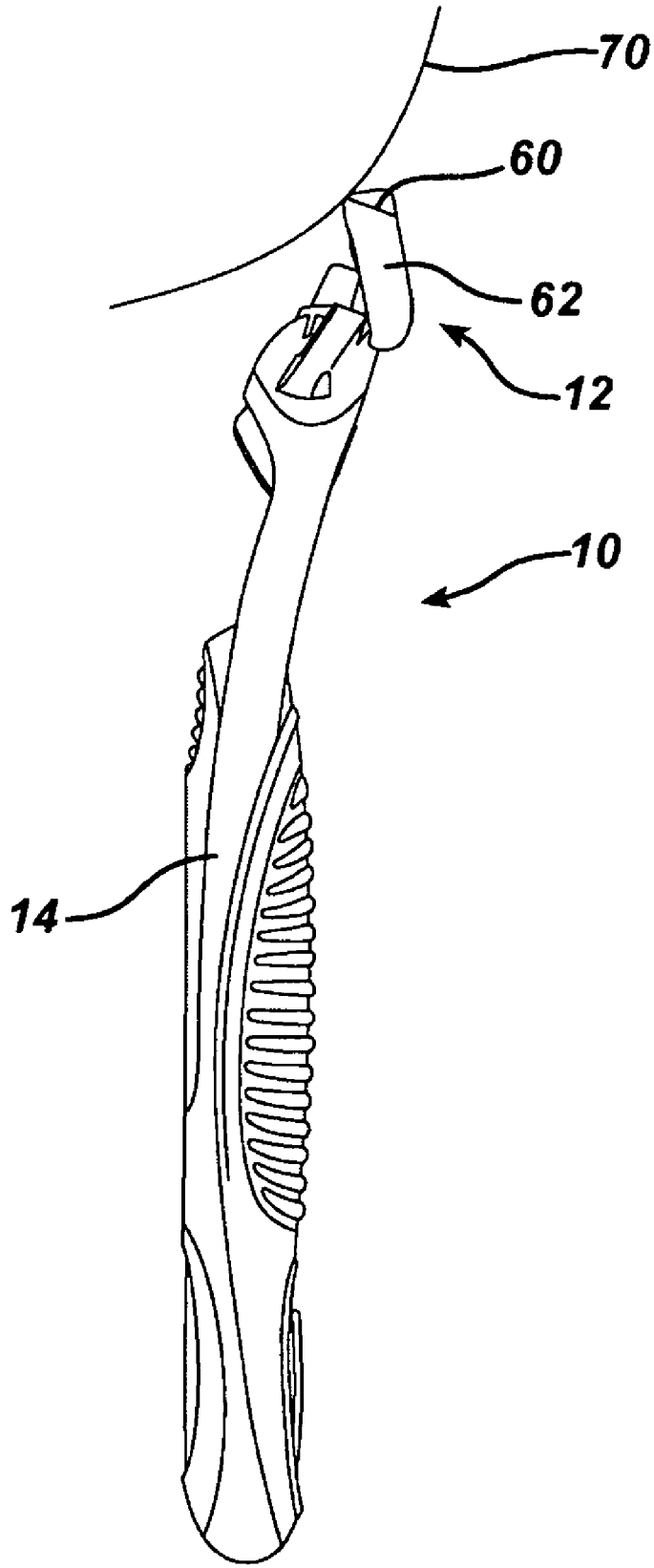
FIG. 4 shows the FIG. 1 shaving razor being applied to the skin for shaving.

Referring now to FIG. 4, shaving razor 10 is held in a position such that trimming blade 19 (not shown) is in contact with user's skin 70. Trimming blade 19 is not shown as it is concealed from view by housing 12 when viewed from this angle. To enable the user to accurately align the trimming blade edge of the trimming blade on the user's skin, the housing 12 is provided with a trimming blade alignment member 60. The trimming blade alignment member 60 is provided on the side surface 62 of housing 12. An identical blade alignment member is provided on the opposite side surface 64 (shown in FIG. 6.) The trimming blade alignment member 60 indicates the position of trimming blade 19 and trimming blade edge 20. The trimming blade alignment member 60 indicates the position of trimming blade 19 and trimming blade edge 20 by providing a visual indication on housing 12. When shaving the face a user can readily see the alignment member 60 with the aid of a mirror and can accurately position the trimming blade edge 20 on the intended location to enable accurate shaving.

As seen in FIG. 4, the alignment member 60 is a linear marking on the housing 12. The alignment member 60 is provided on the side surface 62 of housing 12. In addition to aligning the trimming blade edge accurately on the user skin, the alignment member 60 also indicates the angle at which the housing is to be held relative to the user's skin 70. In FIG. 4, the alignment member 60 is positioned on housing 12 to be held substantially perpendicular to the user's skin 70, or substantially at a 90° angle to the user's skin 70.

The alignment member 60 may be a first color and the housing 12 may be a second color different from the first color. For example, the alignment member may be orange and the housing blue. Alternatively, the alignment member may be a first shade of orange such as dark orange, and the housing may be a lighter shade of orange.

The alignment member 60 may be printed or painted on the housing 12. The alignment member 60 may be incorporated into the original mold to make housing 12. The alignment member 60 may be a sticker which is applied to housing 12. The alignment member 60 may be a separate member that is secured to housing 12. For example, the separate member may be metal, plastic or rubber that is secured to housing 12 by any conventional means.

Figure 5:
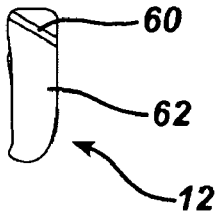
FIG. 5 is a side view of an alternative embodiment of a housing of the present invention.
Figure 6:
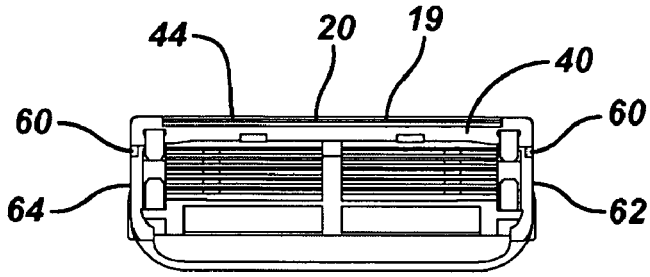
FIG. 6 is a plan view of the front or first side of the housing of FIG. 5.

Referring now to FIGS. 5 and 6, there is shown a housing 12 having an alignment member 60 on side surfaces 62 and 64. Each alignment member 60 is a recess in housing 12. As seen in FIG. 6, the upper portion of the recess of alignment member 60 aligns with the blade edge 20 of trimmer blade 19. Housing 12 has a guard structure 40 before blade 19 and a cap structure 44 after blade 19.

Figure 7:
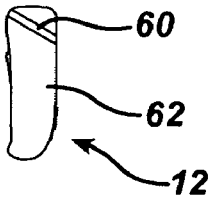
FIG. 7 is a side view of an alternative embodiment of a housing of the present invention.
Figure 8:
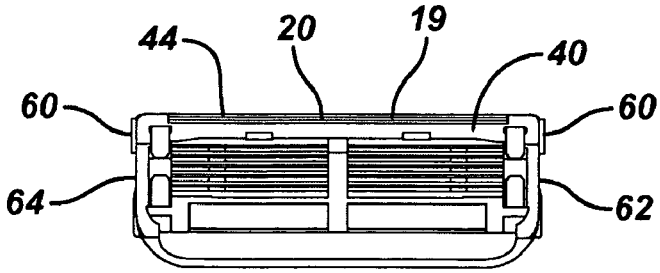
FIG. 8 is a plan view of the front or first side of the housing of FIG. 7.

Referring now to FIGS. 7 and 8, there is shown a housing 12 having an alignment member 60 on side surfaces 62 and 64. Each alignment member 60 is a protrusion extending outward from housing 12. As seen in FIG. 8, the upper portion of the protrusion of alignment member 60 aligns with the blade edge 20 of trimmer blade 19. Housing 12 has a guard structure 40 before blade 19 and a cap structure after blade 19.

The alignment member 60 may be a high illumination element such reflective material. The alignment member 60 may be a luminescent marking on the housing. The alignment member 60 may be an electrically activated component such as a light emitting diode.

Figure 9:
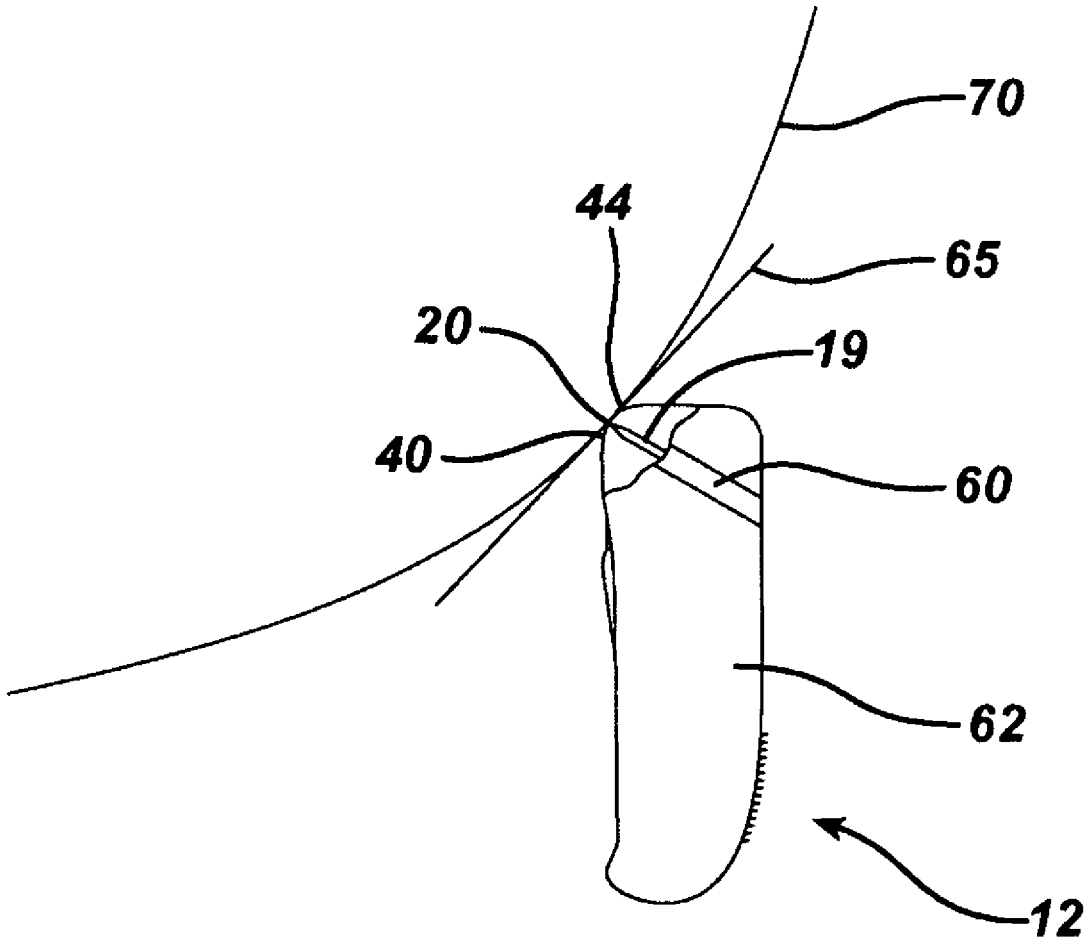
FIG. 9 shows a partially cut away view of the FIG. 1 shaving razor housing being applied to the skin for shaving.

Referring now to FIG. 9, housing 12 has a skin contact surface or guard 40 which contacts the skin 70 before blade edge 20 of trimming blade 19. A skin contact surface or cap 44 contacts the skin behind blade edge 20 of trimming blade 19. Skin contact surfaces 40 and 44 are provided on the housing for contact with the skin in front of and behind the blade edge 20 of blade 19 during the performance of a shaving stroke. The alignment member 60 which is a linear marking on side edge 62 of housing 12 extends substantially perpendicular to a plane 65 tangential to the skin contact surfaces 40 and 44 and substantially intersects the blade edge 20 position projected longitudinally of the blade edge.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. A shaving razor comprising:

a housing having a first side, a second side, a third side and a fourth side opposite the third side;

a plurality of shaving blades each having a cutting edge on the first side of the housing;

a separate trimming blade located in the housing, the trimming blade having a trimming blade edge on the second side, the housing visually concealing the trimming blade edge when viewed by a user with the aid of a mirror from the third or fourth side of the housing during shaving; and a trimming blade alignment member on at least one of the third and fourth sides of the housing, wherein the trimming blade alignment member is visible with the aid of a mirror during a shaving stroke to align the trimming blade edge on a user's skin for accurate shaving.

2. The saving razor according to claim 1, wherein the alignment member substantially intersects the trimming blade edge position projected longitudinally of the trimming blade edge.

3. The shaving razor according to claim 1, wherein the trimming blade alignment member indicates an angle of which the housing is to be held relative to the user's skin during shaving.

4. The shaving razor according to claim 1, wherein the housing has a first color and the trimming blade alignment member has a second color different from the first color.

5. The shaving razor according to claim 1, wherein the trimming blade alignment member comprises a recess in the housing.

6. The shaving razor according to claim 1, wherein the trimming blade alignment member comprises a protrusion on the housing.

7. The shaving razor according to claim 1, wherein the trimming blade alignment member is printed or painted on the housing.

8. The shaving razor according to claim 1, wherein the trimming blade alignment member is integral with the housing.

9. The shaving razor according to claim 1, wherein the trimming blade alignment member include stickers which are applied to the housing.

10. The shaving razor according to claim 1, wherein the trimming blade alignment member is a separate member that is secured to the housing.

11. The shaving razor according to claim 10, wherein the separate member is a different color than the housing.

12. The shaving razor according to claim 11, wherein the separate member has a different color than that of the housing.

13. The shaving razor according to claim 1, further comprising a second trimming blade alignment member on at least the other of the third and fourth sides of the housing.

14. A shaving razor comprising:

a housing having a first side, a second side, a third side and a fourth side opposite the third side;

a plurality of shaving blades each having a cutting edge on the first side of the housing;

a separate trimming blade located in the housing, the trimming blade having a trimming blade edge on the second side, the housing visually concealing the trimming blade edge when viewed by a user with the aid of a mirror from the third or fourth side of the housing during shaving; and a first trimming blade alignment member on the third side of the housing; and a second trimming blade alignment member on the fourth side opposite of the third side of the housing, wherein the first or second trimming blade alignment member is visible with the aid of a mirror during a shaving stroke to align the trimming blade edge on a user's skin for accurate shaving.

15. The shaving razor according to claim 14, wherein the alignment members substantially intersect the trimming blade edge position projected longitudinally of the trimming blade edge.

16. The shaving razor according to claim 14, wherein the trimming blade alignment members indicates an angle at which the housing is to be held relative to the user's skin during shaving.

17. The shaving razor according to claim 14, wherein each trimming blade alignment member comprises a protrusion on the housing.

18. The shaving razor according to claim 14, wherein each trimming blade alignment member is a separate member that is secured to the housing.

19. The shaving razor according to claim 18, wherein the separate member is a plastic component that is secured to the housing.

20. The shaving razor according to claim 19, wherein the separate member has a different color than the housing.

* * * * *

UNITED STATES PATENT AND TRADEMARK OFFICE

CERTIFICATE OF CORRECTION

PATENT NO. : 7,739,797 B2
APPLICATION NO. : 12/430267
DATED : June 22, 2010
INVENTOR(S) : Stephen Leonard Rawle It is certified that error appears in the above-identified patent and that said Letters Patent is hereby corrected as shown below:

Column 4:
Claim 2, line 1, "saving" should read --shaving--.

Signed and Sealed this

Thirty-first Day of August, 2010

David J. Kappos

David J. Kappos
*Director of the United States Patent and Trademark Office*